US012733776B2

(12) United States Patent
Wu

(10) Patent No.: US 12,733,776 B2
(45) Date of Patent: Sep. 15, 2026

(54) ARC-SHAPED SHOWER CURTAIN ROD

(71) Applicant: Libing Wu, Zhoukou City (CN)

(72) Inventor: Libing Wu, Zhoukou City (CN)

( * ) Notice: Subject to any disclaimer, the term of this patent is extended or adjusted under 35 U.S.C. 154(b) by 95 days.

(21) Appl. No.: 18/894,243

(22) Filed: Sep. 24, 2024

(65) Prior Publication Data

US 2026/0020725 A1 Jan. 22, 2026

(30) Foreign Application Priority Data

Jul. 22, 2024 (CN) ..... 202421751011.9

(51) Int. Cl.
*A47K 3/38* (2006.01)

(52) U.S. Cl.
CPC ..... *A47K 3/38* (2013.01)

(58) Field of Classification Search
CPC ... A47K 3/38; A47H 2001/0205; A47H 1/022
See application file for complete search history.

(56) References Cited

U.S. PATENT DOCUMENTS 9,271,592 B2 * 3/2016 Didehvar ..... A47H 1/142
2021/0378433 A1 * 12/2021 Berman ..... A47H 1/022

FOREIGN PATENT DOCUMENTS

CN 211582552 U 9/2020

* cited by examiner

*Primary Examiner* — Janie M Loeppke

(57) ABSTRACT

Disclosed is an arc-shaped shower curtain rod that can be split into a plurality of first rod bodies. Individual first rod bodies sleeved with second bodies can withdraw the second rod bodies through sleeving structures. After the arc-shaped shower curtain rod is split and the second rod bodies are withdrawn, the occupied space is effectively reduced, and the transportation convenience is improved. Moreover, the arc-shaped shower curtain rod is expanded or reduced for adaptation by increasing or decreasing the quantity of the first rod bodies and adjusting the size of the arc-shaped shower curtain rod through the second rod bodies according to the size of a shower room, reflecting excellent universality of the arc-shaped shower curtain rod.

9 Claims, 3 Drawing Sheets

ARC-SHAPED SHOWER CURTAIN ROD

CROSS REFERENCE TO RELATED APPLICATION

This application claims priority benefit of Chinese patent Application No. 202421751011.9, filed on Jul. 22, 2024, and the entire contents of which are incorporated herein by reference.

TECHNICAL FIELD

The present invention relates to the technical field of shower curtain rods, and particularly relates to an arc-shaped shower curtain rod.

BACKGROUND

At present, a suspended shower curtain will be usually used in an indoor shower room of a family, a hotel, and the like to partition the shower room to avoid the inconvenience of walking on a too-wet floor of the shower room as a result of water splashing during bathing. The shower curtain which is suspended is mainly supported by a shower curtain rod, that is, the shower curtain is suspended by mounting the shower curtain rod on a wall space.

A conventional shower curtain rod is usually of a "-"-shaped, L-shaped or arc-shaped structure integrally formed. Although the integrally formed shower curtain rod is aesthetic as a whole, the integrally formed shower curtain rod occupies a large space and is inconvenient to transport as it cannot be dismounted. Moreover, due to the different sizes of the shower rooms, the integrally formed shower curtain rod is low in universality.

SUMMARY

A major object of the present invention is to provide an arc-shaped shower curtain rod, which is intended to solve the problems of large occupied space, difficulty in transportation, and low universality of an existing shower curtain rod that is integrally formed.

To achieve the above object, the present invention provides an arc-shaped shower curtain rod, including a plurality of arc-shaped first rod bodies connected successively, where a connecting member is arranged between two adjacent first rod bodies, two first rod bodies are detachably and fixedly connected to both ends of the connecting member, respectively, the first rod bodies at one end or both ends of the arc-shaped shower curtain rod is/are sleeved with second rod bodies, and the end of each of the second rod bodies away from each of the first rod bodies can move between a position close to each of the first rod bodies and a position away from each of the first rod bodies.

Preferably, both ends of the arc-shaped shower curtain rod are provided with mounting bases for being connected to positions to be mounted, each of the mounting bases is provided with an insertion hole, and an end part of the arc-shaped shower curtain rod can be locked through a screw after being inserted into the insertion hole.

Preferably, each of the mounting bases includes a base body for being connected to each of the positions to be mounted and a swinging piece provided with the insertion hole, and the swinging piece is pivotably mounted on the base body and can swing relative to the base body.

Preferably, each of the second rod bodies is arc-shaped, the diameter of each of the second rod bodies is less than the diameter of each of the first rod bodies, each of the first rod bodies is of a tubular structure opened at both ends, and each of the second rod bodies is movably inserted into each of the first rod bodies.

Preferably, a cutting sleeve is arranged at an end part of one end of the first rod body correspondingly located at the end of the arc-shaped shower curtain rod and close to the second rod body, an outer wall of the cutting sleeve is in contact with an interior of the first rod body, and an inner wall of the cutting sleeve is in contact with an outer wall of the second rod body.

Preferably, the connecting member is strip-shaped, both ends of the connecting member are connected to end openings of the two adjacent first rod bodies in an inserted manner, respectively, an elastic strip with a hook part is formed on an end part of the connecting member, each of the first rod bodies is provided with a locking hole where the hook part can be locked, and after the end part of the connecting member is connected to the end openings of the first rod bodies in an inserted manner, the hook part is located in the locking hole to restrain the connecting member from being separated from each of the first rod bodies.

Preferably, an edge part leaning against an end wall of each of the first rod bodies is formed in the middle of the connecting member.

Preferably, a positioning part is formed in the middle of the connecting member, a position at the end part of each of the first rod bodies corresponding to the positioning part is provided with a positioning hole, and after the two adjacent first rod bodies are fixed through the connecting member, the positioning part is located in the positioning hole.

Preferably, a strip-shaped part is formed on an outer wall of the connecting member, and after the two adjacent first rod bodies are fixed through the connecting member, the strip-shaped part leans against the inner wall of each of the first rod bodies.

Preferably, the first rod bodies, the second rod bodies, and the connecting members all are metal products, plastic products or rubber products.

According to the technical solution of the present invention, the plurality of arc-shaped first rod bodies are connected successively to form the complete arc-shaped shower curtain rod, where the two adjacent first rods are detachably and fixedly connected through the connecting member, the first rod bodies at one end or both ends of the arc-shaped shower curtain rod is/are sleeved with second rod bodies, and the end of each of the second rod bodies away from each of the first rod bodies can move between a position close to each of the first rod bodies and a position away from each of the first rod bodies, so that the size of the arc-shaped shower curtain rod is adjusted. Both ends of the arc-shaped shower curtain rod are respectively fixed to the corresponding positions to be mounted to complete assembly. The arc-shaped shower curtain rod is simple in integral structure and convenient to mount. Compared with a conventional arc-shaped shower curtain rod, the arc-shaped shower curtain rod in the present invention can be split into a plurality of first rod bodies. Individual first rod bodies sleeved with second bodies can withdraw the second rod bodies through sleeving structures. After the arc-shaped shower curtain rod is split and the second rod bodies are withdrawn, the occupied space is effectively reduced, and the transportation convenience is improved. Moreover, the arc-shaped shower curtain rod is expanded or reduced for adaptation by increasing or decreasing the quantity of the first rod bodies and adjusting the size of the arc-shaped shower curtain rod through the second rod bodies according to the size of a shower room, reflecting excellent universality of the arc-shaped shower curtain rod.

DETAILED DESCRIPTION OF THE EMBODIMENTS

Figure 1:
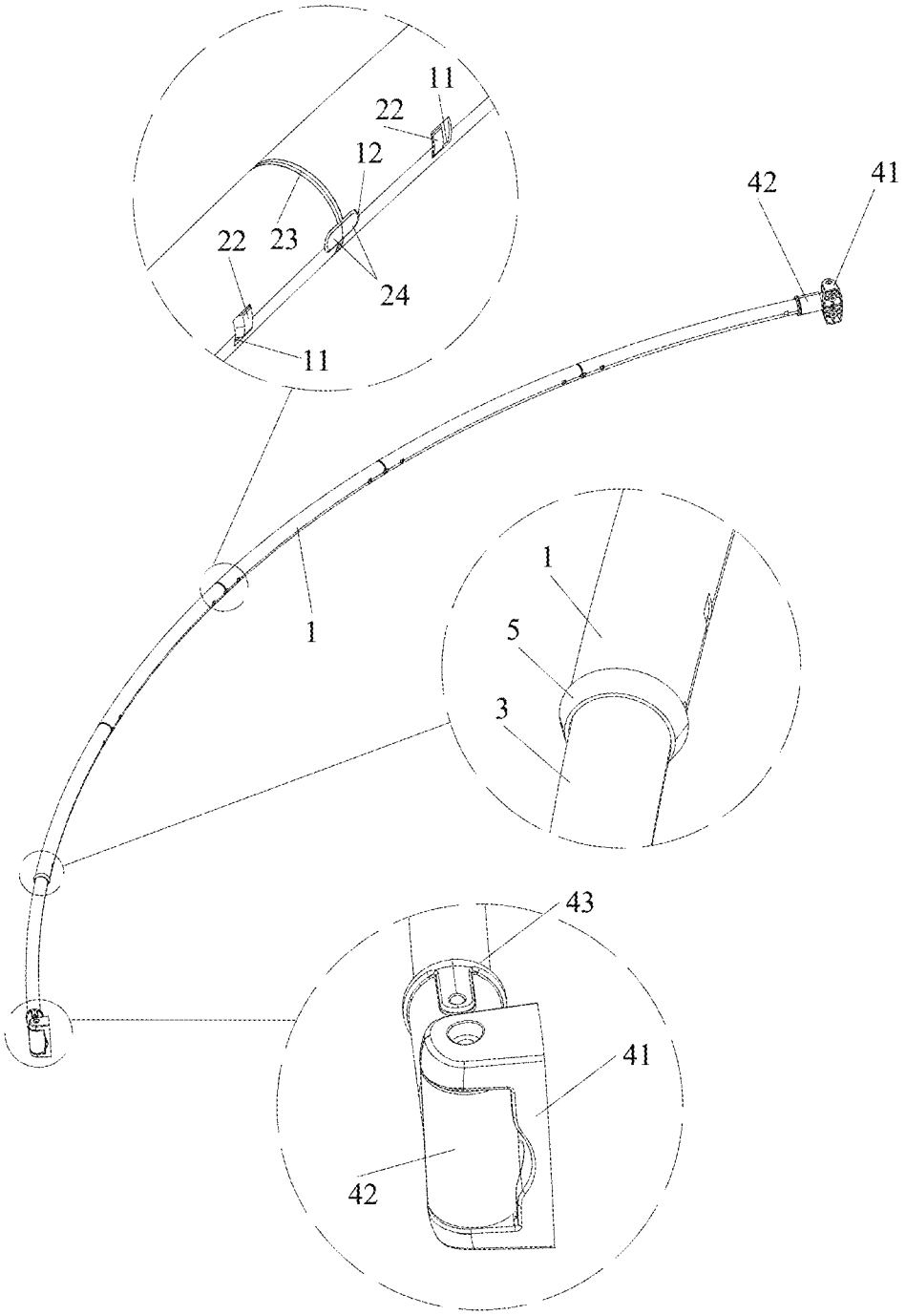
FIG. 1 is a schematic diagram of the present invention.

The technical solutions in the embodiments of the present invention will be described clearly and completely below in combination with drawings. Apparently, the described embodiments are merely a part of embodiments, rather than all the embodiments of the present invention. On the basis of the embodiments in the present invention, all other embodiments obtained by persons skilled in the technical field without creative efforts fall into the scope of protection of the present invention.

It is necessary to note that if there are directional indications (such as upper, lower, left, right, front, back, top, bottom, inner, outer, vertical, horizontal, longitudinal, anti-clockwise, clockwise, circumferential, radial, and axial) in the embodiments of the present invention, the directional indications are merely used for explaining relative position relations, moving conditions, and the like among components in a certain special gesture (as shown in the drawings). If the special gesture changes, the directional indications change correspondingly.

In addition, if there are descriptions of "first", "second", and the like in the embodiments of the present invention, the descriptions of "first", "second", and the like are merely used for a description purpose rather than being construed to indicate or imply relative importance or implicitly indicate the quantity of indicated technical features. Thus, features defining "first", "second", and the like can expressively or implicitly include at least one feature. In addition, the technical solutions of the embodiments may be combined with one another based on implementation by persons of ordinary skill in the field. When the technical solutions contradict each other in combination or may not be realized, it is to be considered that there is no combination of the technical solutions, which shall not fall into the protection scope of the present invention.

The present invention provides an arc-shaped shower curtain rod.

Figure 2:
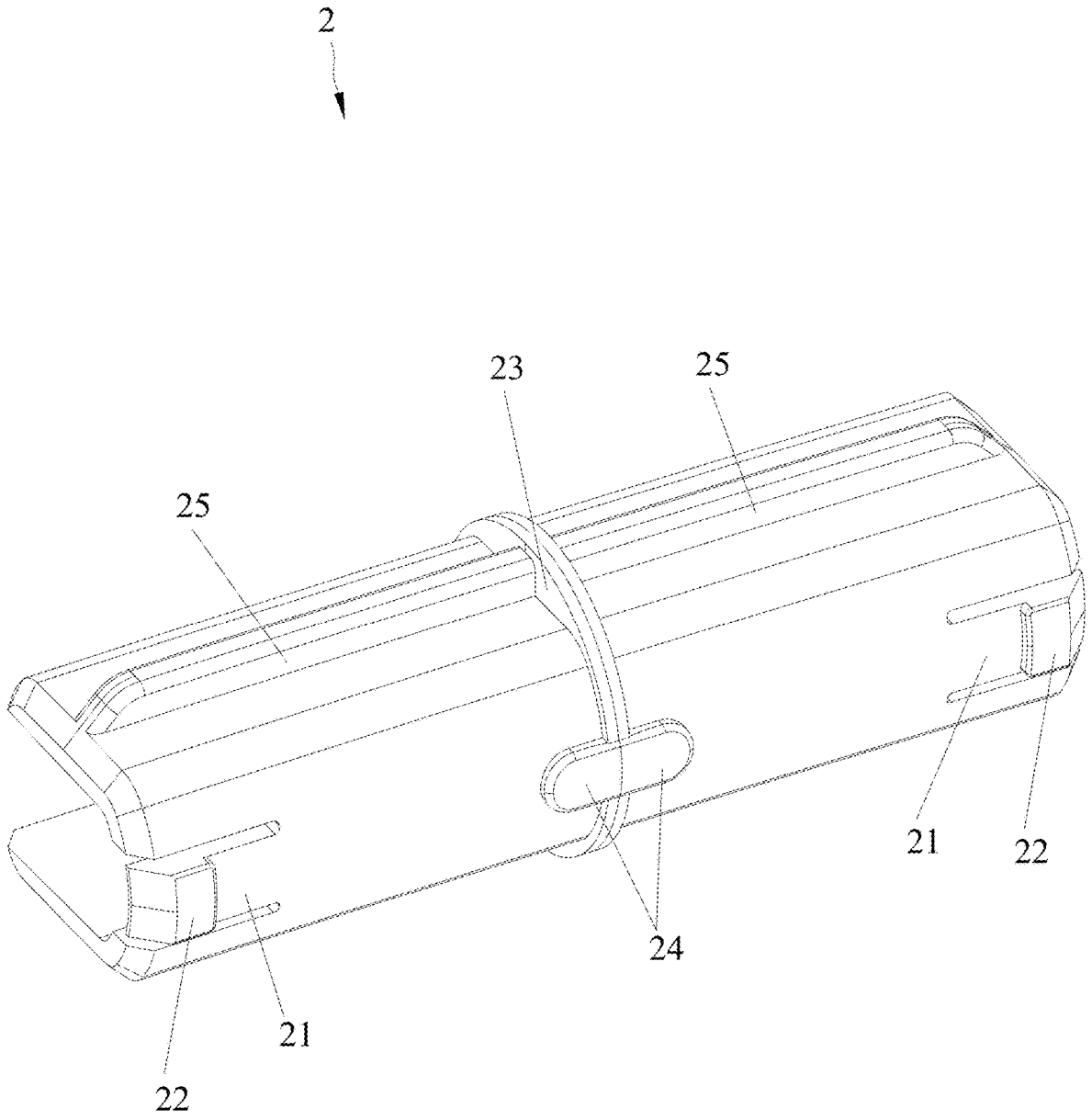
FIG. 2 is a schematic diagram of a connecting member.
Figure 3:
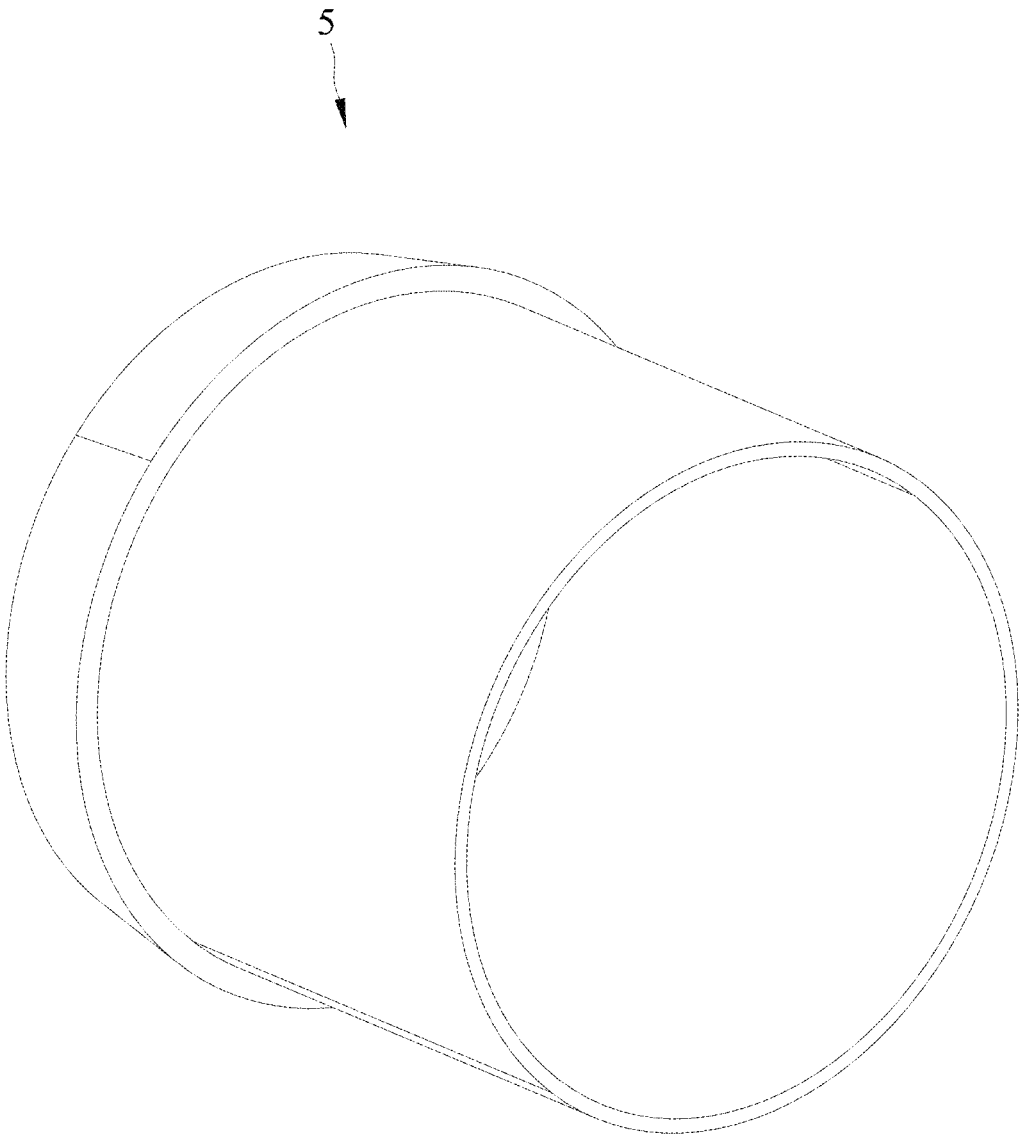
FIG. 3 is a schematic diagram of a cutting sleeve.

In the embodiment of the present invention, as shown in FIGS. 1-3, the arc-shaped shower curtain rod includes a plurality of arc-shaped first rod bodies 1 connected successively, where a connecting member 2 is arranged between two adjacent first rod bodies 1, two first rod bodies 1 are detachably and fixedly connected to both ends of the connecting member 2, respectively, the first rod bodies 1 at one end or both ends of the arc-shaped shower curtain rod is/are sleeved with second rod bodies 3, and the end of each of the second rod bodies 3 away from each of the first rod bodies 1 can move between a position close to each of the first rod bodies 1 and a position away from each of the first rod bodies.

Specifically, both ends of the arc-shaped shower curtain rod are provided with mounting bases for being connected to positions to be mounted, each of the mounting bases is provided with an insertion hole 43, and an end part of the arc-shaped shower curtain rod can be locked through a screw after being inserted into the insertion hole 43.

Specifically, each of the mounting bases includes a base body 41 for being connected to each of the positions to be mounted and a swinging piece 42 provided with the insertion hole 43, and the swinging piece 42 is pivotably mounted on the base body 41 and can swing relative to the base body 41. Therefore, the base body 41 can swing relative to the shower curtain rod to fit the position to be mounted. For example, when the position to be mounted inclines relative to the shower curtain rod, the base body 41 leaning against the position to be mounted can be assembled by way of screw locking, buckling structure fixing, glue or double faced adhesive tape binding and fixing by swinging the base body 41 without changing the position and angle of the shower curtain rod.

Specifically, each of the second rod bodies 3 is arc-shaped, the diameter of each of the second rod bodies 3 is less than the diameter of each of the first rod bodies 1, each of the first rod bodies 1 is of a tubular structure opened at both ends, and each of the second rod bodies 3 is movably inserted into each of the first rod bodies 1.

Specifically, a cutting sleeve 5 is arranged at an end part of one end of the first rod body 1 correspondingly located at the end of the arc-shaped shower curtain rod and close to the second rod body 3, an outer wall of the cutting sleeve 5 is in contact with an interior of the first rod body 1, and an inner wall of the cutting sleeve 5 is in contact with an outer wall of the second rod body 3.

Specifically, the cutting sleeve 5 is made of rubber or plastic. The inner wall of the cutting sleeve is in elastic contact with the outer wall of the second rod body 3, so that the first rod body 1 and the second rod body 3 are fixed. As the first rod body 1 and the second rod body 3 are incompletely fixed, the second rod body 3 can be forced to move through an external force. In the moving process, the surface of the second rod body 3 is prevented from being scratched by the cutting sleeve 5.

Specifically, the connecting member 2 is strip-shaped, both ends of the connecting member are connected to end openings of the two adjacent first rod bodies 1 in an inserted manner, respectively, an elastic strip 21 with a hook part 22 is formed on an end part of the connecting member 2, each of the first rod bodies 1 is provided with a locking hole 11 where the hook part 22 can be locked, and after the end part of the connecting member 2 is connected to the end openings of the first rod bodies 1 in an inserted manner, the hook part 22 is located in the locking hole 11 to restrain the connecting member 2 from being separated from each of the first rod bodies 1. When it is needed to relieve the insertion fit between the connecting member 2 and the first rod body 1, the elastic strip 21 can be forced to deform through an external force, so that the hook part 22 retreats from the locking hole 11.

Specifically, an edge part 23 leaning against an end wall of each of the first rod bodies 1 is formed in the middle of the connecting member 2.

Specifically, a positioning part 24 is formed in the middle of the connecting member 2, a position at the end part of each of the first rod bodies 1 corresponding to the positioning part 24 is provided with a positioning hole 12, and after the two adjacent first rod bodies 1 are fixed through the connecting member 2, the positioning part 24 is located in the positioning hole 12.

Specifically, a strip-shaped part 25 is formed on an outer wall of the connecting member 2, and after the two adjacent first rod bodies 1 are fixed through the connecting member 2, the strip-shaped part 25 leans against the inner wall of each of the first rod bodies 1. The connecting tightness between the connecting member 2 and each of the first rod bodies 1 is enhanced.

Specifically, the first rod bodies 1, the second rod bodies 3, and the connecting members 2 all are metal products, plastic products or rubber products.

According to the technical solution of the present invention, the plurality of arc-shaped first rod bodies are connected successively to form the complete arc-shaped shower curtain rod, where the two adjacent first rods are detachably and fixedly connected through the connecting member, the first rod bodies at one end or both ends of the arc-shaped shower curtain rod is/are sleeved with second rod bodies, and the end of each of the second rod bodies away from each of the first rod bodies can move between a position close to each of the first rod bodies and a position away from each of the first rod bodies, so that the size of the arc-shaped shower curtain rod is adjusted. Both ends of the arc-shaped shower curtain rod are respectively fixed to the corresponding positions to be mounted to complete assembly. The arc-shaped shower curtain rod is simple in integral structure and convenient to mount. Compared with a conventional arc-shaped shower curtain rod, the arc-shaped shower curtain rod in the present invention can be split into a plurality of first rod bodies. Individual first rod bodies sleeved with second bodies can withdraw the second rod bodies through sleeving structures. After the arc-shaped shower curtain rod is split and the second rod bodies are withdrawn, the occupied space is effectively reduced, and the transportation convenience is improved. Moreover, the arc-shaped shower curtain rod is expanded or reduced for adaptation by increasing or decreasing the quantity of the first rod bodies and adjusting the size of the arc-shaped shower curtain rod through the second rod bodies according to the size of a shower room, reflecting excellent universality of the arc-shaped shower curtain rod.

The above are merely preferred embodiments of the present invention and are not intended to limit the patent scope of the present invention. Equivalent structure transformations made by utilizing the contents of the specification and drawings of the present invention or direct/indirection applications in other related technical fields under the concept of the present invention all shall be included in the scope of patent protection of the present invention.

What is claimed is:

1. An arc-shaped shower curtain rod, comprising a plurality of first rod bodies connected successively, wherein the first rod bodies are arc-shaped, a connecting member is arranged between two adjacent first rod bodies, two first rod bodies are detachably and fixedly connected to both ends of the connecting member, respectively, the first rod bodies at one end or both ends of the arc-shaped shower curtain rod is/are sleeved with second rod bodies, and the end of each of the second rod bodies away from each of the first rod bodies can move between a position close to each of the first rod bodies and a position away from each of the first rod bodies;

wherein each of the second rod bodies is arc-shaped, the diameter of each of the second rod bodies is less than the diameter of each of the first rod bodies, each of the first rod bodies is of a tubular structure opened at both ends, and each of the second rod bodies is movably inserted into each of the first rod bodies.

2. The arc-shaped shower curtain rod according to claim 1, wherein both ends of the arc-shaped shower curtain rod are provided with mounting bases for being connected to positions to be mounted, each of the mounting bases is provided with an insertion hole, and an end part of the arc-shaped shower curtain rod can be locked through a screw after being inserted into the insertion hole.

3. The arc-shaped shower curtain rod according to claim 2, wherein each of the mounting bases comprises a base body for being connected to each of the positions to be mounted and a swinging piece provided with the insertion hole, and the swinging piece is pivotably mounted on the base body and can swing relative to the base body.

4. The arc-shaped shower curtain rod according to claim 1, wherein a cutting sleeve is arranged at an end part of one end of the first rod body correspondingly located at the end of the arc-shaped shower curtain rod and close to the second rod body, an outer wall of the cutting sleeve is in contact with an interior of the first rod body, and an inner wall of the cutting sleeve is in contact with an outer wall of the second rod body.

5. The arc-shaped shower curtain rod according to claim 1, wherein the connecting member is strip-shaped, both ends of the connecting member are connected to end openings of the two adjacent first rod bodies in an inserted manner, respectively, an elastic strip is formed on an end part of the connecting member, the elastic strip has a hook part, each of the first rod bodies is provided with a locking hole where the hook part can be locked, and after the end part of the connecting member is connected to the end openings of the first rod bodies in an inserted manner, the hook part is located in the locking hole to restrain the connecting member from being separated from each of the first rod bodies.

6. The arc-shaped shower curtain rod according to claim 5, wherein an edge part leaning against an end wall of each of the first rod bodies is formed in the middle of the connecting member.

7. The arc-shaped shower curtain rod according to claim 5, wherein a positioning part is formed in the middle of the connecting member, a position at the end part of each of the first rod bodies corresponding to the positioning part is provided with a positioning hole, and after the two adjacent first rod bodies are fixed through the connecting member, the positioning part is located in the positioning hole.

8. The arc-shaped shower curtain rod according to claim 5, wherein a strip-shaped part is formed on an outer wall of the connecting member, and after the two adjacent first rod bodies are fixed through the connecting member, the strip-shaped part leans against the inner wall of each of the first rod bodies.

9. The arc-shaped shower curtain rod according to claim 1, wherein the first rod bodies, the second rod bodies, and the connecting members all are metal products, plastic products or rubber products.

* * * * *